US008886091B2

(12) United States Patent
Takiguchi

(10) Patent No.: US 8,886,091 B2
(45) Date of Patent: Nov. 11, 2014

(54) DETACHABLE UNIT AND IMAGE FORMING APPARATUS

(75) Inventor: Toshio Takiguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 201 days.

(21) Appl. No.: 13/401,376

(22) Filed: Feb. 21, 2012

(65) Prior Publication Data

US 2013/0077994 A1 Mar. 28, 2013

(30) Foreign Application Priority Data

Sep. 22, 2011 (JP) ..... 2011-207789

(51) Int. Cl.
*G03G 21/12* (2006.01)
*G03G 21/16* (2006.01)

(52) U.S. Cl.
CPC ..... *G03G 21/1647* (2013.01)
USPC ..... 399/123; 399/360

(58) Field of Classification Search
None
See application file for complete search history.

(56) References Cited

FOREIGN PATENT DOCUMENTS

| | | | | |
|---|---|---|---|---|
| JP | 2003-156946 A | | 5/2003 | |
| JP | 2009-169050 A | | 7/2009 | |
| JP | 2010-186196 A | * | 8/2010 | ..... G03G 21/10 |

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A detachable unit includes a detachable unit body to be attached to an image forming apparatus body such as to be detachable in a predetermined detachment direction, a grip part provided in the detachable unit body, and a latch portion provided in the detachable unit body, the latch portion being latched in a latched portion provided in the image forming apparatus body to restrict detachment of the detachable unit body from the image forming apparatus body in a state in which the detachable unit body is attached to the image forming apparatus body, and withdrawing from a latch position in the latched portion in conjunction with a pull-out operation of pulling out the grip part from the detachable unit body in the detachment direction.

9 Claims, 16 Drawing Sheets

DETACHABLE UNIT AND IMAGE FORMING APPARATUS

CROSS-REFERENCE TO RELATED APPLICATIONS

This application is based on and claims priority under 35 USC 119 from Japanese Patent Application No. 2011-207789 filed Sep. 22, 2011.

BACKGROUND

1. Technical Field

The present invention relates to a detachable unit and an image forming apparatus.

2. Summary

According to an aspect of the invention, there is provided a detachable unit including: a detachable unit body to be attached to an image forming apparatus body such as to be detachable in a predetermined detachment direction; a grip part provided in the detachable unit body; and a latch portion provided in the detachable unit body, the latch portion being latched in a latched portion provided in the image forming apparatus body to restrict detachment of the detachable unit body from the image forming apparatus body in a state in which the detachable unit body is attached to the image forming apparatus body, and withdrawing from a latch position in the latched portion in conjunction with a pull-out operation of pulling out the grip part from the detachable unit body in the detachment direction.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below with reference to the drawings.

Configuration of Image Forming Apparatus of Exemplary Embodiment

Figure 1:
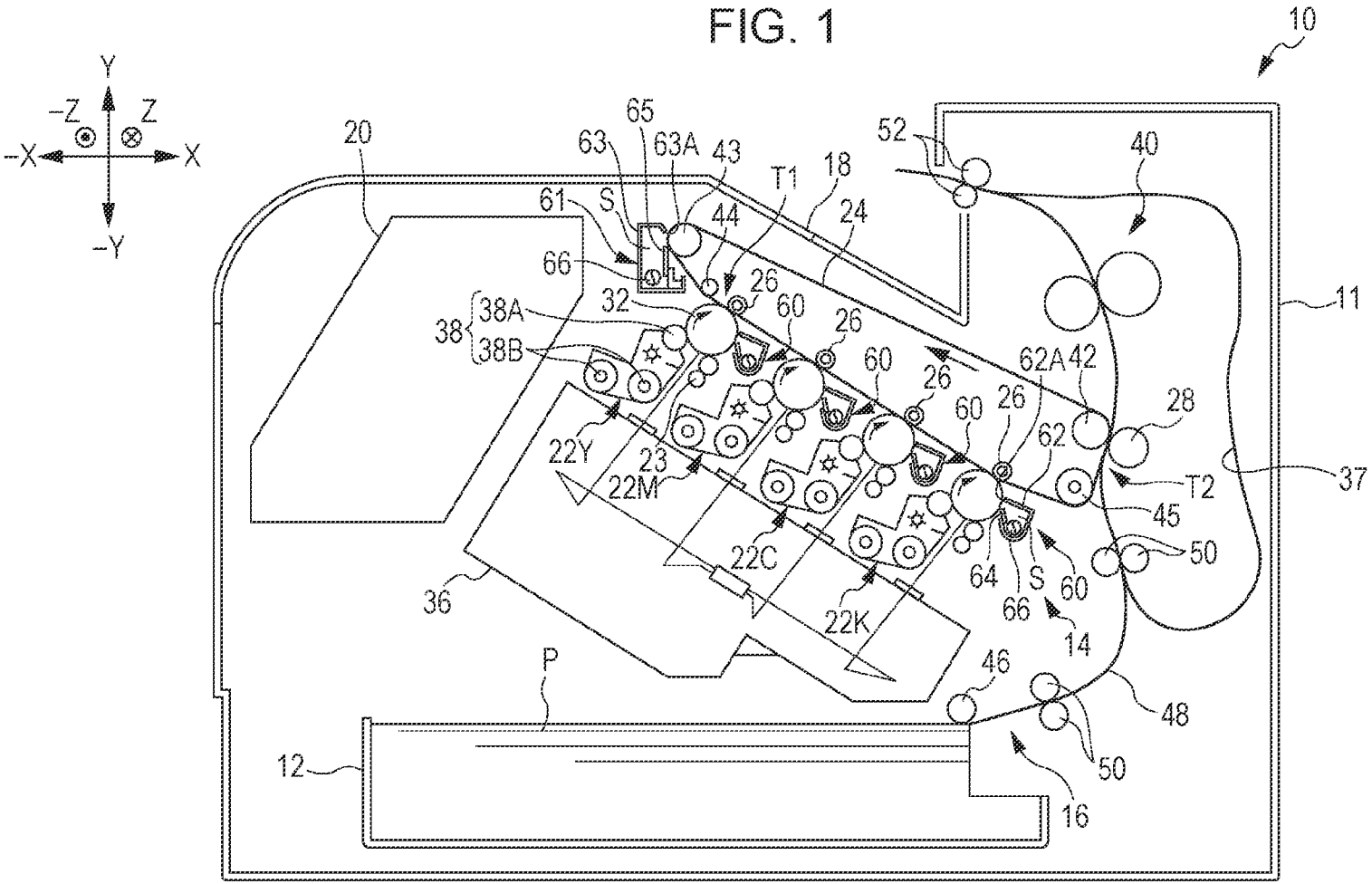
FIG. 1 schematically illustrates a configuration of an image forming apparatus according to an exemplary embodiment.

First, a configuration of an image forming apparatus 10 according to an exemplary embodiment will be described. FIG. 1 schematically illustrates the configuration of the image forming apparatus 10 of the exemplary embodiment. An X-direction, a −X direction, a Y-direction (upward direction), a −Y-direction (downward direction), a Z-direction, and a −Z-direction described below are directions of arrows in the drawings. In the drawings, an encircled cross represents an arrow pointing from a front side toward a depth side of paper of the drawings, and an encircled dot represents an arrow pointing from the depth side toward the front side of the paper.

As illustrated in FIG. 1, the image forming apparatus 10 has an image forming apparatus body 11 in which components are provided. In the image forming apparatus body 11, a storage section 12, an image forming section 14, a transport section 16, and a controller 20 are provided. Recording media P, such as sheets of paper, are stored in the storage section 12. The image forming section 14 forms an image on each recording medium P. The transport section 16 transports the recording medium P from the storage section 12 to the image forming section 14. The controller 20 controls operations of the sections of the image forming apparatus 10. At the top of the image forming apparatus body 11, an output portion 18 is provided so that the recording medium P is output therein after an image is formed on the recording medium P by the image forming section 14.

The image forming section 14 includes image forming units 22Y, 22M, 22C, and 22K (hereinafter referred to as image forming units 22Y to 22K), an intermediate transfer belt 24, first transfer rollers 26, and a second transfer roller 28. The image forming units 22Y to 22K form toner images of colors, yellow (Y), magenta (M), cyan (C), and black (K). The toner images formed by the image forming units 22Y to 22K are to be transferred on the intermediate transfer belt 24. The first transfer rollers 26 transfer the toner images formed by the image forming units 22Y to 22K onto the intermediate transfer belt 24. The second transfer roller 28 transfers the toner images, which are transferred on the intermediate transfer belt 24 by the first transfer rollers 26, from the intermediate transfer belt 24 onto a recording medium P. The structure of the image forming section 14 is not limited to the above-described structure, and may have any structure that forms an image on a recording medium P.

In the image forming apparatus body 11, the image forming units 22Y to 22K are arranged in a direction inclined with respect to a horizontal direction (X-direction). Each of the image forming units 22Y to 22K includes a photoconductor 32 that rotates in one direction (e.g., a clockwise direction in FIG. 1). Since the image forming units 22Y to 22K are similar in structure, reference numerals of the components in the image forming units 22M, 22C, and 22K are not shown in FIG. 1.

Around each photoconductor 32, a charging roller 23 and a developing device 38 are arranged in order from an upstream side in a rotating direction of the photoconductor 32. The charging roller 23 serves as an example of a charging device that charges the photoconductor 32. The developing device 38 develops, into a toner image, an electrostatic latent image that is formed on the photoconductor 32, which is charged by the charging roller 23, by exposing the photoconductor 32 with a below-described exposure device 36.

The exposure device 36 is provided on an obliquely lower side of the image forming units 22Y to 22K. The exposure device 36 exposes the photoconductor 32 charged by the charging roller 23 so as to form an electrostatic latent image on the photoconductor 32. The exposure device 36 forms an electrostatic latent image on the basis of an image signal sent from the controller 20, for example, an image signal that the controller 20 acquires from an external apparatus.

The developing device 38 includes a developer supplier 38A that supplies developer to the photoconductor 32, and plural transport members 38B that transport the developer to the developer supplier developing body 38A while agitating the developer.

The intermediate transfer belt 24 is ring-shaped, and is provided on an upper side (Y-direction side) of the image forming units 22Y to 22K. On an inner peripheral side of the intermediate transfer belt 24, winding rollers 42, 43, 44, and 45 are provided such that the intermediate transfer belt 24 is wound thereon. When any of the winding rollers 42, 43, 44, and 45 rotates, the intermediate transfer belt 24 circles (rotates) in one direction (e.g., a counterclockwise direction in FIG. 1) while being in contact with the photoconductor 32. The winding roller 42 serves an opposing roller opposing the second transfer roller 28.

Each first transfer roller 26 opposes the corresponding photoconductor 32 with the intermediate transfer belt 24 being disposed therebetween. Between the first transfer roller 26 and the photoconductor 32, a first transfer position T1 where the toner image formed on the photoconductor 32 is transferred onto the intermediate transfer belt 24 is set.

The second transfer roller 28 opposes the winding roller 42 with the intermediate transfer belt 24 being disposed therebetween. Between the second transfer roller 28 and the winding roller 42, a second transfer position T2 where the toner image transferred on the intermediate transfer belt 24 is transferred onto a recording medium P is set.

The transport section 16 includes a feed roller 46 that feeds a recording medium P from the storage section 12, a transport path 48 through which the recording medium P fed by the feed roller 46 is transported, and plural transport rollers 50 arranged along the transport path 48. The transport rollers 50 transport the recording medium P fed by the feed roller 46 to the second transfer position T2.

On a downstream side of the second transfer position T2 in the transport direction, a fixing device 40 is provided to fix, on the recording medium P, the toner image formed on the recording medium P by the image forming section 14. On a downstream side of the fixing device 40 in the transport direction, output rollers 52 are provided to output, into the output portion 18, the recording medium P on which the toner image is fixed.

On a side of the transport path 48 opposite the intermediate transfer belt 24 (X-direction side), a reverse transport path 37 is provided. The reverse transport path 37 reverses the recording medium P with the toner image fixed on one surface and transports the recording medium P back to the second transfer position T2 again. To form images on both surfaces of a recording medium P, after a toner image is fixed on one surface of the recording medium P, the recording medium P is switched back by the output rollers 52, is guided into the reverse transport path 37, and is transported back to the second transfer position T2.

In the exemplary embodiment, the image forming units 22Y to 22K are detachably mounted in the image forming apparatus body 11. The intermediate transfer belt 24 is combined with a below-described removing device 61 into a unit, and is detachably mounted in the image forming apparatus body 11 together with the removing device 61.

Next, a description will be given of image forming operations of forming an image on a recording medium P in the image forming apparatus 10 of the exemplary embodiment.

In the image forming apparatus 10 of the exemplary embodiment, a recording medium P is fed out from the storage section 12 by the feed roller 46, and is then transported to the second transfer position T2 by the plural transport rollers 50.

In each of the image forming units 22Y to 22K, the photoconductor 32 charged by the charging roller 23 is exposed by the exposure device 36, so that an electrostatic latent image is formed on the photoconductor 32. The electrostatic latent image is developed by the developing device 38 to form a toner image on the photoconductor 32. Color toner images formed in the image forming units 22Y to 22K are superimposed on the intermediate transfer belt 24 at the first transfer position T1 to form a color image. The color image formed on the intermediate transfer belt 24 is transferred onto the recording medium P at the second transfer position T2.

After the color image is transferred, the recording medium P is transported to the fixing device 40, where the transferred image is fixed. To form an image only on one surface of the recording medium P, the recording medium P is output to the output portion 18 by the output rollers 52 after the toner image is fixed. To form images on both surfaces of the recording medium P, the recording medium P is switched back by the output rollers 52 after an image is formed on one surface, and is then transported into the reverse transport path 37 in a reversed state. Further, the recording medium P is transported from the reverse transport path 37 to the second transfer position T2 again, and an image is formed on an opposite surface, similarly to the above. After images are formed on both surfaces of the recording medium P, the recording medium P is output to the output portion 18 by the output rollers 52. As described above, a series of image forming operations are performed.

Removing Device for Removing Residual Toner

Next, a description will be given of a removing device for removing residual toner.

As illustrated in FIG. 1, each of the image forming units 22Y and 22K includes a removing device 60 that removes residual toner remaining on the photoconductor 32 after the toner image is transferred on the intermediate transfer belt 24. The removing device 60 is provided on an outer periphery of the photoconductor 32, on a downstream side of the first transfer position T1 in the rotating direction of the photoconductor 32, and on an upstream side of the charging roller 23 in the rotating direction of the photoconductor 32.

The removing device 60 includes a housing 62 in which components of the removing device 60 are provided, a removing member 64 provided in the housing 62 to remove residual toner remaining on the photoconductor 32 by contact with the photoconductor 32, and a transport member 66 provided in the housing 62 to transport, to a below-described toner container 80 (see FIG. 7), the residual toner removed by the removing member 64.

The housing 62 has an opening 62A opening at a position opposing the photoconductor 32 (on a photoconductor 32 side). In the housing 62, a receiving space S that receives the residual toner removed by the removing member 64 is provided.

The removing member 64 is provided at the opening 62A of the housing 62 such that a distal end thereof is in contact with the photoconductor 32. For example, the removing member 64 is formed by a blade made of rubber that scrapes off the residual toner from the photoconductor 32 by contact with the photoconductor 32. The residual toner removed by the removing member 64 is received in the receiving space S of the housing 62, for example, under its own weight.

Since removing devices 60 in the image forming units 22Y to 22K are similar in structure, reference numerals of the removing devices 60 in the image forming units 22Y, 22M, and 22C are not shown in FIG. 1.

The image forming apparatus 10 further includes a removing device 61 that removes residual toner remaining on the intermediate transfer belt 24 after the toner image is transferred on the recording medium P. The removing device 61 is provided on an outer periphery of the intermediate transfer belt 24 and at a position opposing the winding roller 43 with the intermediate transfer belt 24 being disposed therebetween.

The removing device 61 includes a housing 63 in which components of the removing device 61 are provided, a removing member 65 provided in the housing 63 to remove residual toner remaining on the intermediate transfer belt 24 by contact with the intermediate transfer belt 24, and a transport member 66 provided in the housing 63 to transport, to the below-described toner container 80 (see FIG. 7), the residual toner removed by the removing member 65.

The housing 63 has an opening 63A opening at a position opposing the intermediate transfer belt 24 (on an intermediate transfer belt 24 side (X-direction side)). In the housing 63, a receiving space S that receives the residual toner removed by the removing member 65 is provided.

The removing member 65 is provided at the opening 63A of the housing 63 such that a distal end thereof is in contact with the intermediate transfer belt 24. For example, the removing member 65 is formed by a blade made of rubber that scrapes off the residual toner from the intermediate transfer belt 24 by contact with the intermediate transfer belt 24. The residual toner removed by the removing member 65 is received in the receiving space S of the housing 63, for example, under its own weight.

Specific Structures of Transport Members 66 and Discharge Pipes 68

Next, specific structures of the transport members 66 and discharge pipes 68 will be described. Since structures of the transport member 66 and discharge pipe 68 in the removing device 61 are similar to those of the transport members 66 and discharge pipes 68 in the removing devices 60, descriptions thereof will be appropriately skipped.

Figure 2:
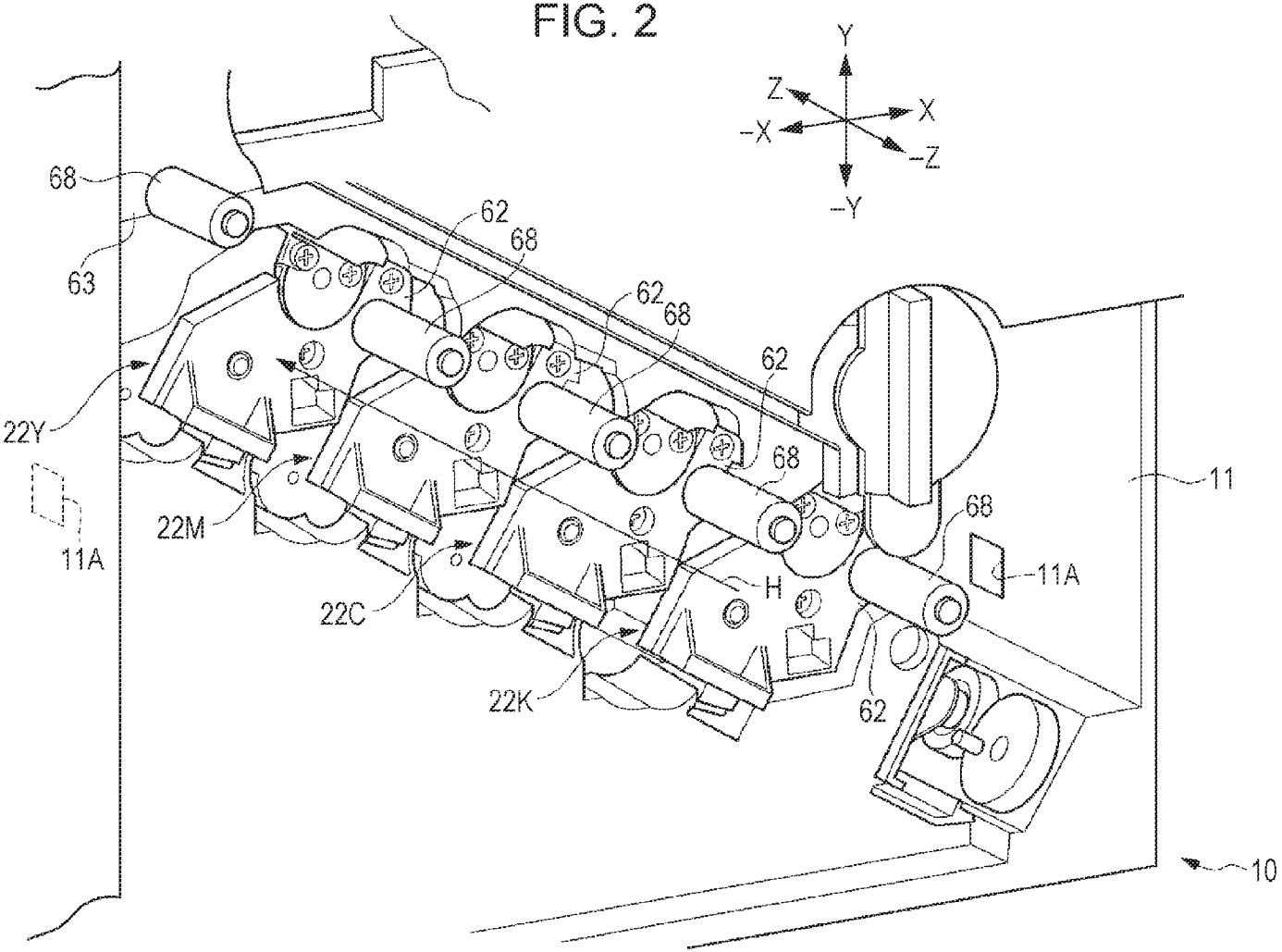
FIG. 2 is a structural perspective view of an image forming apparatus body from which a storage container is removed in the exemplary embodiment.

As illustrated in FIG. 2, each of the image forming units 22Y to 22K includes a discharge pipe 68 projecting from the housing 62 of the removing device 60 in the horizontal direction (−Z-direction). The discharge pipe 68 communicates with the receiving space S in the housing 62 (see FIG. 1), and residual toner received in the receiving space S in the housing 62 can flow into the discharge pipe 68. The removing device 61 includes a discharge pipe 68 projecting from the housing 63 in the horizontal direction (−Z-direction). The discharge pipe 68 communicates with the receiving space S in the housing 63 (see FIG. 1).

Figure 3:
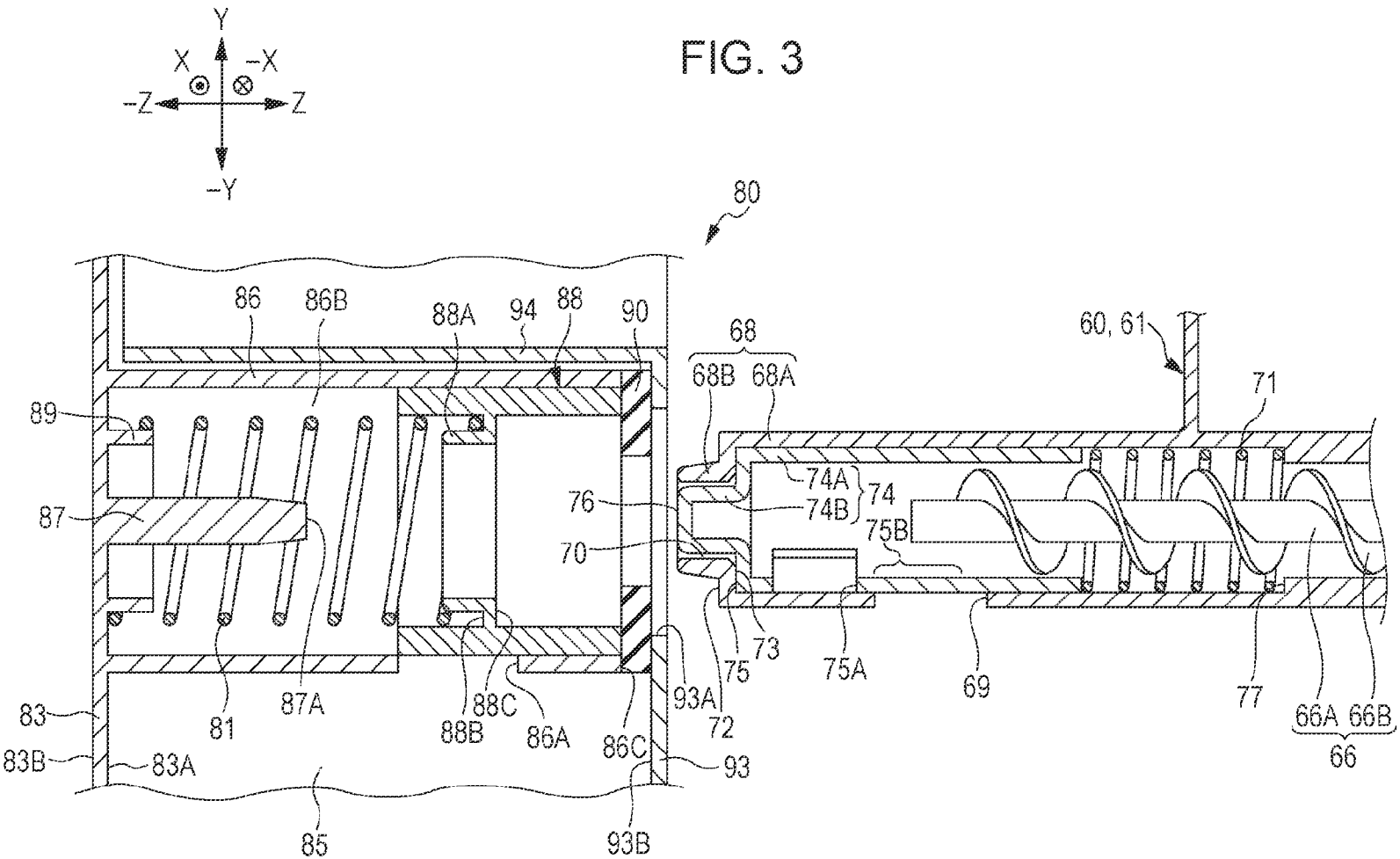
FIG. 3 is a structural cross-sectional view of a part of the storage container and a discharge pipe in the exemplary embodiment.

One end (Z-direction end) of each transport member 66 is located in the corresponding housing 62 (the housing 63 in the removing device 61), and the other end (−Z-direction end) of the transport member 66 is located in the corresponding discharge pipe 68, as illustrated in FIG. 3. That is, the transport member 66 extends from the receiving space S in the housing 62 (the housing 63 in the removing device 61) (see FIG. 1) into the discharge pipe 68.

The transport member 66 includes a rotatable rotation shaft 66A and a spiral member 66B spirally formed around the rotation shaft 66A. Although not illustrated, one end (Z-direction end) of the rotation shaft 66A is rotatably supported by a Z-direction side wall of the housing 62. The one end (z-direction end) of the rotation shaft 66A receives a rotation force from an unillustrated motor so that the rotation shaft 66A rotates. The spiral member 66B transports residual toner from the receiving space S in the housing 62 (see FIG. 1) to the discharge pipe 68 along with the rotation of the rotation shaft 66A.

The discharge pipe 68 includes a large-diameter portion 68A, and a small-diameter portion 68B provided coaxially with the large-diameter portion 68A and integrally with a distal end (−Z-direction end) of the large-diameter portion 68A. At the distal end (−Z-direction end) of the large-diameter portion 68A, a pressing face 72 for pressing a pressed face 88C of a below-described shutter 88 is provided in an annular form on a radial outer side of the small-diameter portion 68B and around the axis of the small-diameter portion 68B. The pressing face 72 faces toward a distal end (−Z-direction end) of the small-diameter portion 68B.

A face of the discharge pipe 68 opposite the pressing face 72 (on the Z-direction side) serves as a restricting face 73 that restricts movement of a below-described opening and closing pipe 74 by contact with a restricted face 75 of the opening and closing pipe 74. The restricting face 73 faces toward a rear side (Z-direction side) of the large-diameter portion 68A.

The small-diameter portion 68B has an insertion hole 70 in which a below-described projecting portion 87 is to be inserted. The insertion hole 70 penetrates the small-diameter portion 68B in the axial direction.

At a middle portion of the large-diameter portion 68A in a projecting direction (−Z-direction) of the discharge pipe 68, a discharge port 69 is provided in a circumferential part on a lower side (−Y-direction side) of a pipe wall of the large-diameter portion 68A. Through the discharge port 69, residual toner is discharged out from the large-diameter portion 68A.

On a portion of an inner wall of the large-diameter portion 68A closer to the rear side (Z-direction side) than the discharge port 69, an annular projecting face 77 projects toward the radial inner side and faces toward the front side (−Z-direction side).

In the discharge pipe 68, an opening and closing pipe 74 for opening and closing the discharge port 69 is provided coaxially with the discharge pipe 68. The opening and closing pipe 74 is movable in the axial direction of the discharge pipe 68 (−Z-direction, Z-direction).

The opening and closing pipe 74 includes a large-diameter portion 74A, and a small-diameter portion 74B provided coaxially with the large-diameter portion 74A and integrally with a distal end (−Z-direction end) of the large-diameter portion 74A. The distal end (−Z-direction end) of the large-diameter portion 74A has an annular restricted face 75 that contacts with the restricting face 73 of the discharge pipe 68 to restrict movement of the opening and closing pipe 74. The restricted face 75 is provided on a radial outer side of the small-diameter portion 74B and around the axis of the small-diameter portion 74B.

The small-diameter portion 74B has a diameter such as to be inserted in the insertion hole 70 of the discharge pipe 68. A distal end face 76 of the small-diameter portion 74B serves as a pressed face to be pressed by a distal end 87A of the below-described projecting portion 87.

In a circumferential part on a lower side (Y-direction side) of a pipe wall at the distal end (−Z-direction end) of the large-diameter portion 74A, an opening port 75A penetrates the pipe wall of the large-diameter portion 74A. The opening port 75A opens the discharge port 69 of the discharge pipe 68. A part of the pipe wall of the opening and closing pipe 74 closer to the rear side (Z-direction side) than the opening port 75A serves as a closing portion 75B that closes the discharge port 69 of the discharge pipe 68.

The opening and closing pipe 74 is movable between a closing position (a position illustrated in FIG. 3) where the discharge port 69 of the discharge pipe 68 is closed by the closing portion 75B in a state in which movement is restricted by contact of the restricted face 75 with the restricting face 73 of the discharge pipe 68, and an opening position (a position illustrated in FIG. 4) where the discharge port 69 of the discharge pipe 68 is opened by the opening port 75A.

Between a rear end of the large-diameter portion 74A of the opening and closing pipe 74 and the projecting face 77 of the large-diameter portion 68A of the discharge pipe 68, a compression coil spring 71 is provided as an example of a biasing member that biases the opening and closing pipe 74 to the closing position.

Structure of Toner Container 80 of Exemplary Embodiment

Next, a structure of a toner container 80 of the exemplary embodiment will be described.

Figure 5:
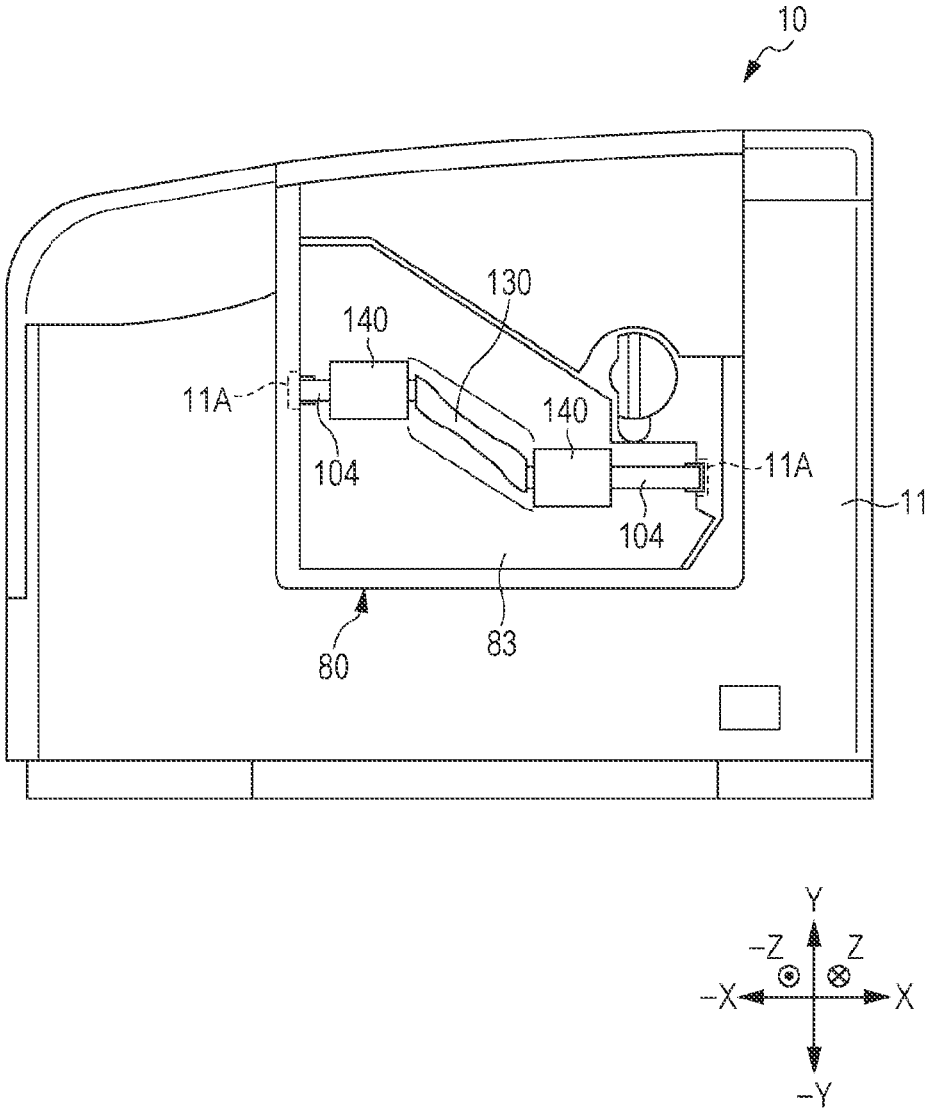
FIG. 5 is a schematic structural view of the image forming apparatus body from which a cover is removed.

The toner container 80 serving as an example of a detachable unit is a storage container that stores residual toner (waste toner) removed by the removing devices 60 and the removing device 61, and is a consumable part to be exchanged when filled with waste toner. As illustrated in FIG. 5, the toner container 80 is detachably mounted in a −Z-direction side portion of the image forming apparatus body 11.

Figure 6:
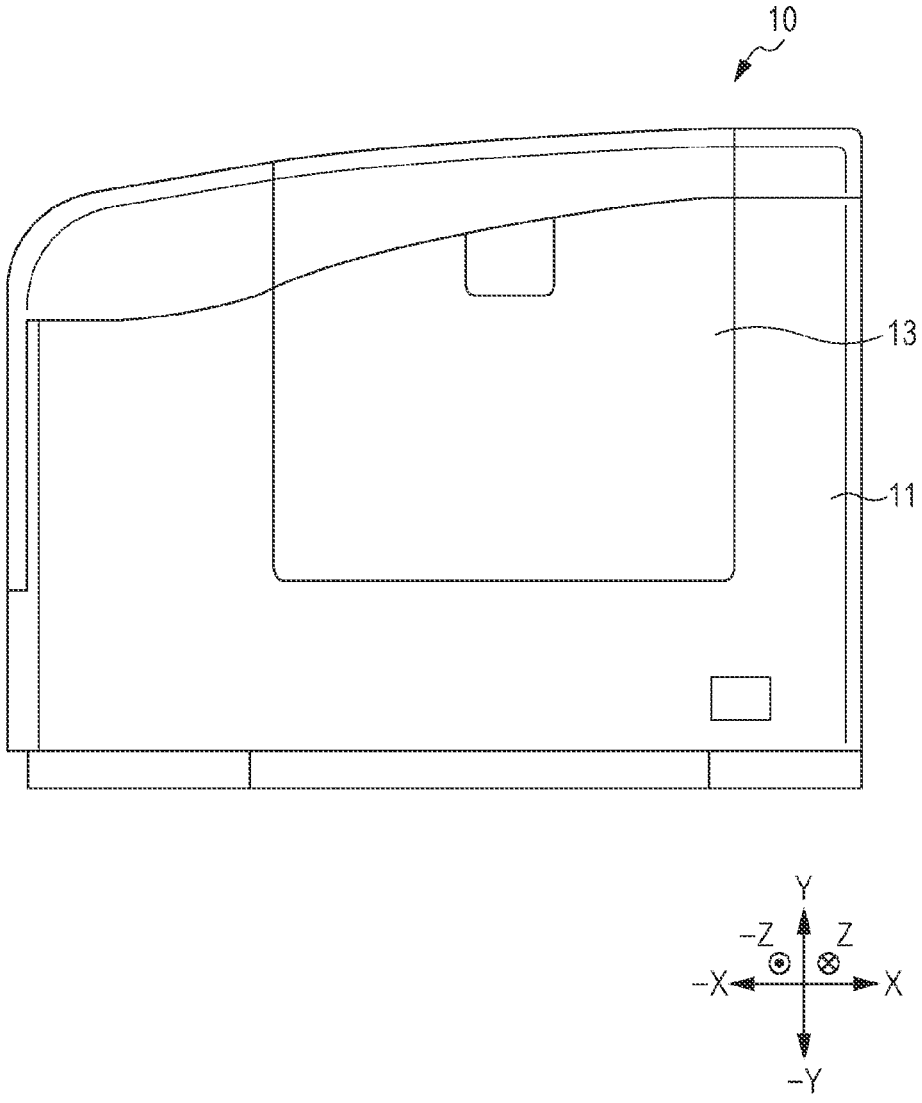
FIG. 6 is a schematic structural view of the image forming apparatus body to which the cover is attached.

As illustrated in FIG. 6, a cover 13 is removably (or openably) attached to the −Z-direction side portion of the image forming apparatus body 11. The cover 13 covers the toner container 80 mounted in the image forming apparatus body 11. Therefore, in a state in which the cover 13 is detached from the image forming apparatus body 11 (or a state in which the cover 13 is opened relative to the image forming apparatus body 11), as illustrated in FIG. 5, the toner container 80 is attached to and detached from the image forming apparatus body 11.

In the exemplary embodiment, the discharge pipes 68 in the removing devices 60 of the image forming units 22Y to 22K and the discharge pipe 68 of the removing device 61 provided at the intermediate transfer belt 24 are inserted in below-described insertion holes 93A of the toner container 80. Hence, to prevent interference between the discharge pipes 68 and the toner container 80, the image forming units 22Y to 22K and the intermediate transfer belt 24 are mounted in and dismounted from the image forming apparatus body 11 in a state in which the toner container 80 is detached from the image forming apparatus body 11.

Figure 4:
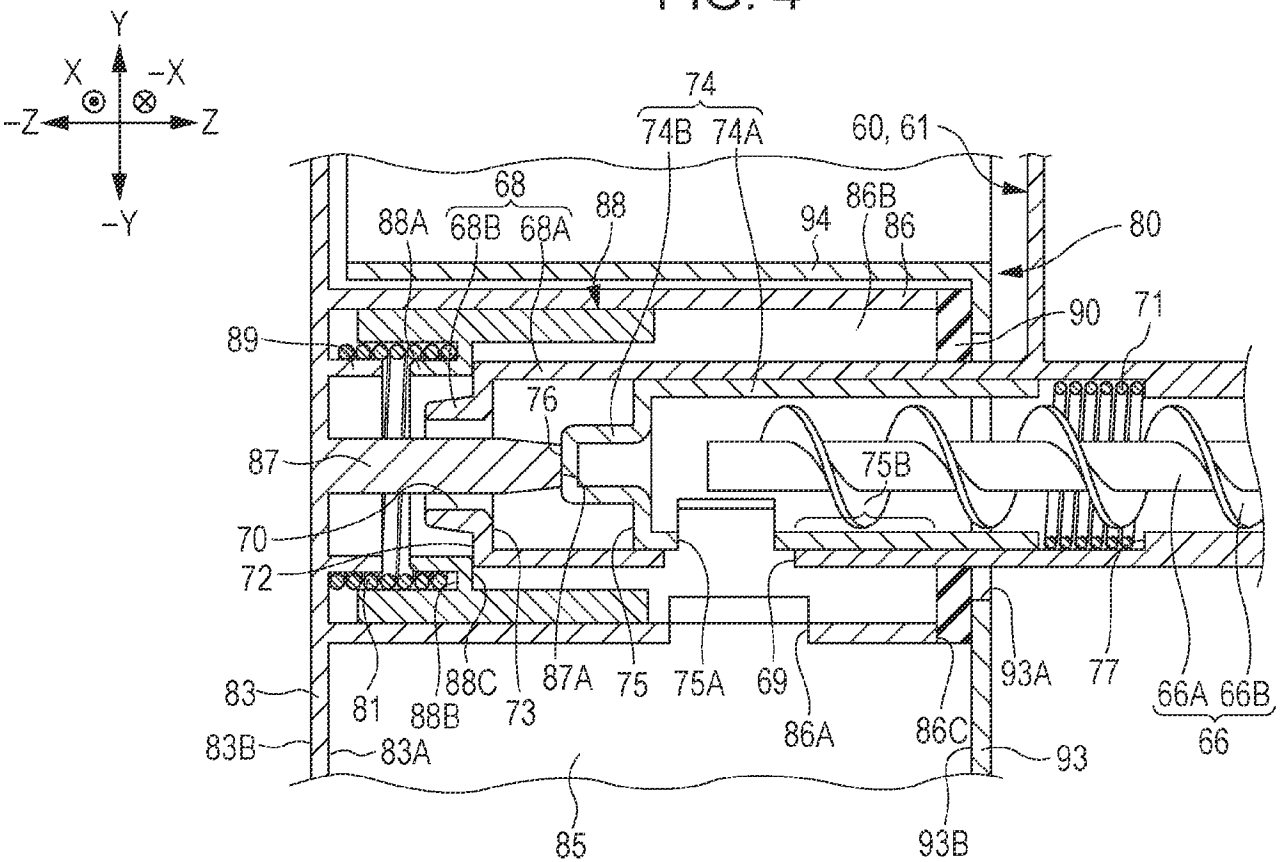
FIG. 4 is a cross-sectional view illustrating a state in which the discharge pipe is inserted in the storage container in the structure of FIG. 3.
Figure 7:
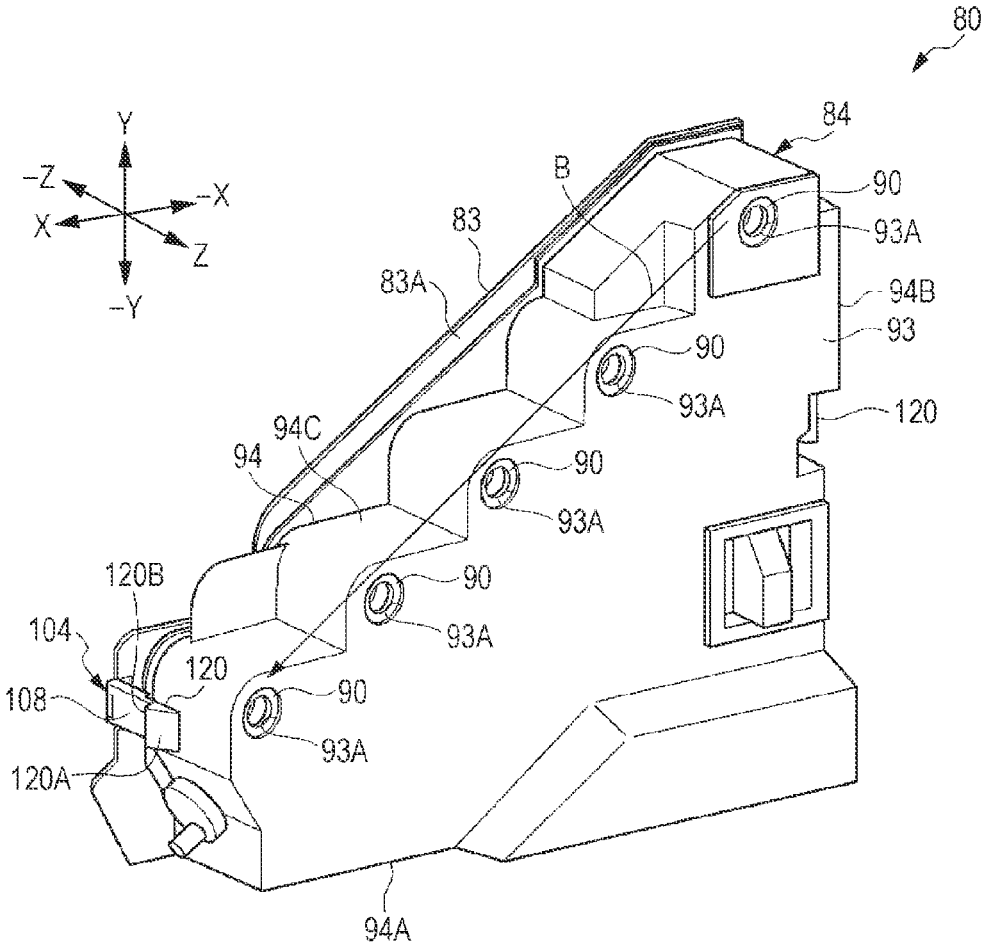
FIG. 7 is a structural perspective view of the storage container in the exemplary embodiment.

As illustrated in FIG. 7, the toner container 80 includes a container body (housing) 84 serving as an example of a detachable unit body to be attached to the image forming apparatus body 11 such as to be detachable in a predetermined detachment direction. As illustrated in FIG. 4, in the container body 84, a receiving portion 85 is provided to receive residual toner discharged from the discharge pipes 68.

As illustrated in FIG. 7, the container body 84 includes an insertion wall 93 having insertion holes 93A in which the discharge pipes 68 are to be inserted, an opposing wall 83 opposing an inserted face 93B (see FIG. 3) provided on a side of the insertion wall 93 where the discharge pipes 68 are inserted, and a surrounding wall 94 provided between the insertion wall 93 and the opposing wall 83 to surround the receiving portion 85 (see FIG. 3).

As illustrated in FIG. 3, the surrounding wall 94 is provided integrally with the insertion wall 93. As illustrated in FIG. 7, the surrounding wall 94 includes a first wall 94A extending in the X-direction at a −Y-direction end of the insertion wall 93, a second wall 94B extending in the Y-direction at a −X-direction end of the insertion wall 93, and a third wall 94C defined by a number of steps corresponding to the number of discharge pipes 68. The steps are arranged in a direction that slopes upward from an X-direction end of the first wall 94A toward a Y-direction end of the second wall 94B. The surrounding wall 94 and the opposing wall 83 are fixed by welding, such as ultrasonic welding or vibration welding, or by screws.

Five insertion holes 93A are arranged at positions corresponding to the five discharge pipes 68 in an arrangement direction H of the discharge pipes 68 (see FIG. 2). Thus, the discharge pipes 68 are inserted in the corresponding insertion holes 93A together (at a time) in conjunction with attachment of the toner container 80 to the image forming apparatus body 11. The insertion holes 93A are formed by circular holes that penetrate the insertion wall 93 in a width direction.

As illustrated in FIG. 3, at a rim of each of the insertion holes 93A on the inserted face 93B of the insertion wall 93, a seal member 90 is provided to seal between the insertion wall 93 and a pressing member 86 (see FIG. 7). As illustrated in FIG. 4, the seal member 90 also functions as a seal member that seals between the discharge pipe 68 inserted in the insertion hole 93A and the insertion wall 93.

The surrounding wall 94 forms an outer wall of the container body 84 with the insertion wall 93 and the opposing wall 83. The surrounding wall 94 may be provided integrally with the opposing wall 83, not with the insertion wall 93.

Figure 8:
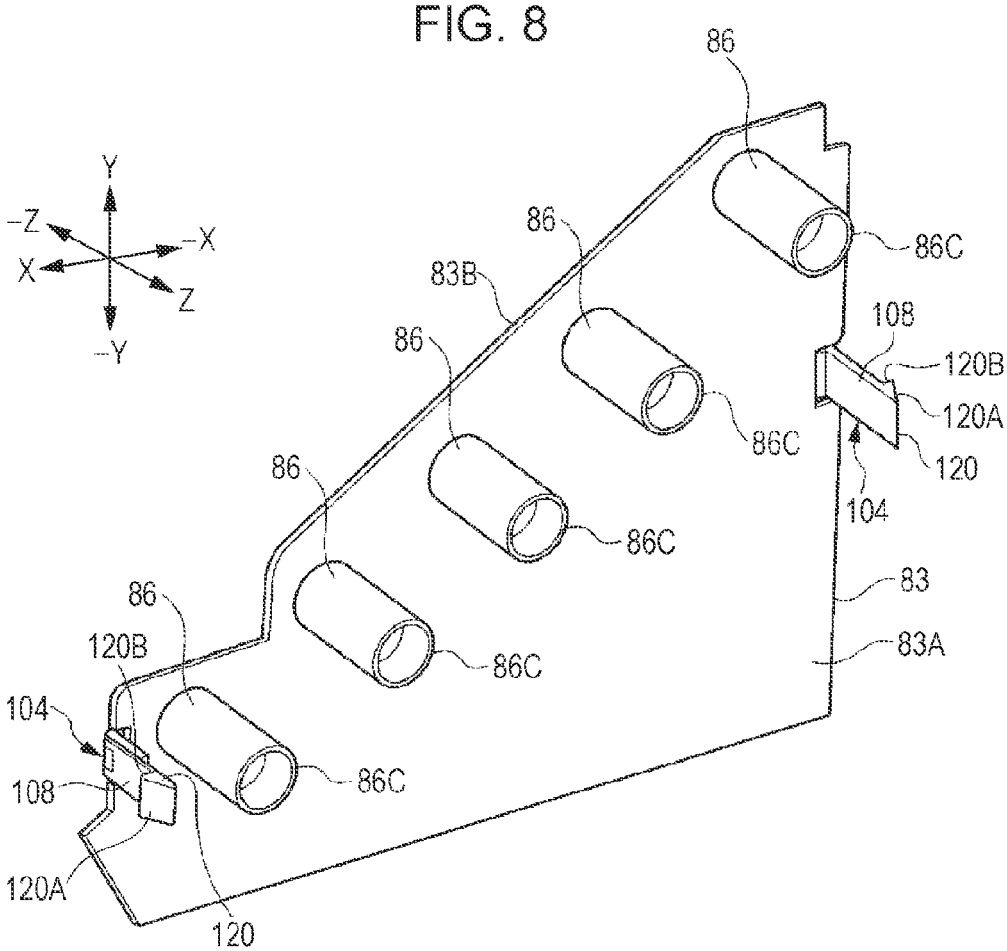
FIG. 8 is a structural perspective view of an opposing wall in the exemplary embodiment.

As illustrated in FIG. 8, the opposing wall 83 has cylindrical walls 86 extending from the opposing wall 83 toward the insertion wall 93 (toward the Z-direction side). More specifically, the cylindrical walls 86 are shaped like cylinders (pipes) whose axial direction is a thickness direction (Z-direction) of the opposing wall 83. The cylindrical walls 86 are provided integrally with the opposing wall 83 such as to project from an opposing face 83A of the opposing wall 83 opposing the insertion wall 93 toward the insertion wall 93 (toward the Z-direction side).

As illustrated in FIG. 3, a distal end 86C (Z-direction end) of each of the cylindrical walls 86 surrounds an outer periphery of the insertion hole 93A, as viewed in the Z-direction. Thus, an insertion space 86B in which the corresponding discharge pipe 68 is to be inserted is formed in the cylindrical wall 86. The insertion space 86B is separated from the receiving portion 85 by the cylindrical wall 86.

A projecting portion 87 is provided on the opposing face 83A of the opposing wall 83 in the cylindrical wall 86. The projecting portion 87 projects in the axial direction of the cylindrical wall 86 toward the insertion wall 93 (Z-direction side). More specifically, the projecting portion 87 is shaped like a rod (column) in the axial center of the cylindrical wall 86. The projecting portion 87 functions as a pressing member that presses the distal end face 76 of the small-diameter portion 74B of the corresponding opening and closing pipe 74 by a distal end 87A against the biasing force of the compression coil spring 71 so as to move the opening and closing pipe 74 to the opening position when the discharge pipe 68 is inserted in the insertion space 86B.

Further, cylindrical holding portions 89 for holding below-described compression coil springs 81 are provided on the opposing face 83A of the opposing wall 83. Each of the holding portions 89 surrounds the outer periphery of the projecting portion 87 around the axis of the projecting portion 87 in the corresponding cylindrical wall 86.

At a middle portion of the cylindrical wall 86 in the projecting direction (Z-direction), an input port 86A is provided so that residual toner flows therethrough from the discharge pipe 68 into the receiving portion 85. The input port 86A is provided in a circumferential part on a lower side (−Y-direction) of a pipe wall of the cylindrical wall 86.

In the cylindrical wall 86, a shutter 88 is provided as an example of an opening and closing portion that opens and closes the input port 86A. The shutter 88 is formed by a cylindrical member provided coaxially with the cylindrical wall 86.

The shutter 88 is movable in the axial direction (−Z-direction, Z-direction) of the cylindrical wall 86 between a closing position to close the input port 86A of the cylindrical wall 86 (a position illustrated in FIG. 3) and an opening position to open the input port 86A (a position illustrated in FIG. 4).

In the shutter 88, an inner cylindrical portion 88A is provided integrally with the shutter 88. Between the inner cylindrical portion 88A and the shutter 88, a holding groove 88B is provided to hold a compression coil spring 81 on the opposing wall 83 side (−Z-direction side).

On an insertion wall 93 side (Z-direction side) of the inner cylindrical portion 88A, a pressed face 88C is provided to be pressed by the pressing face 72 of the discharge pipe 68.

Between the inner cylindrical portion 88A and the opposing wall 83, a compression coil spring 81 is provided as an example of a biasing member that biases the shutter 88 to the closing position. The compression coil spring 81 is held by the holding groove 88B of the inner cylindrical portion 88A and the holding portion 89 of the opposing wall 83.

Structures of Grip part 130 and Latch Members 104 in Toner Container 80

Next, structures of a grip part 130 and latch members 104 in the toner container 80 will be described.

Figure 9:
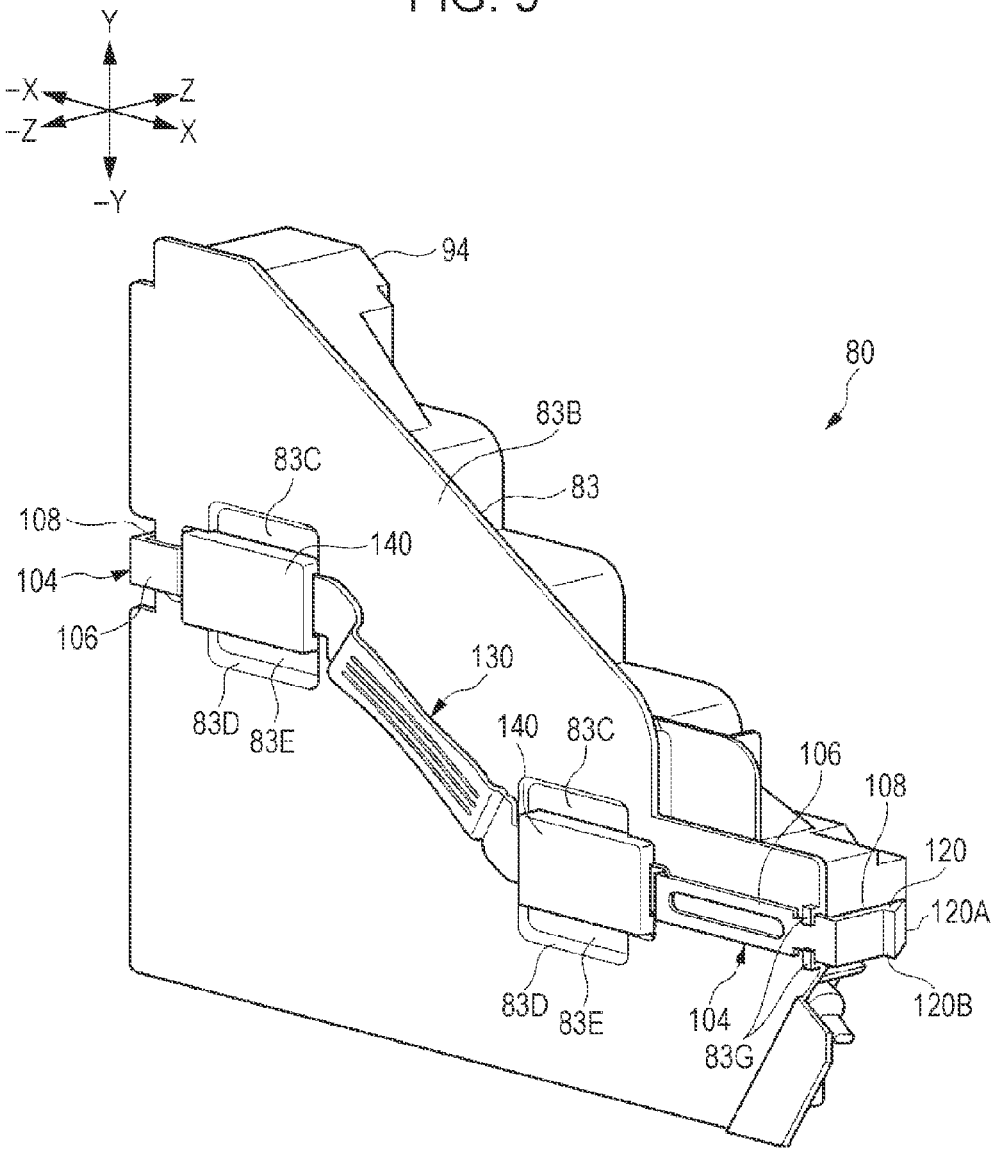
FIG. 9 is a structural perspective view of the storage container.

As illustrated in FIG. 9, the toner container 80 includes a grip part 130 provided on the container body 84, and latch members 104 provided at opposite ends of the grip part 130 in the longitudinal direction (X-direction and −X-direction) on the container body 84. The latch members 104 include latch portions 120 to be latched in latched portions 11A provided in the image forming apparatus body 11 (see FIGS. 2 and 5) (the −X-direction side latch portion 120 is illustrated in FIG. 8).

The latch members 104 are formed of an elastic material, for example, a resin material such as polypropylene (PP) or polyoxymethylene (POM), and are elastically deformable.

Figure 10:
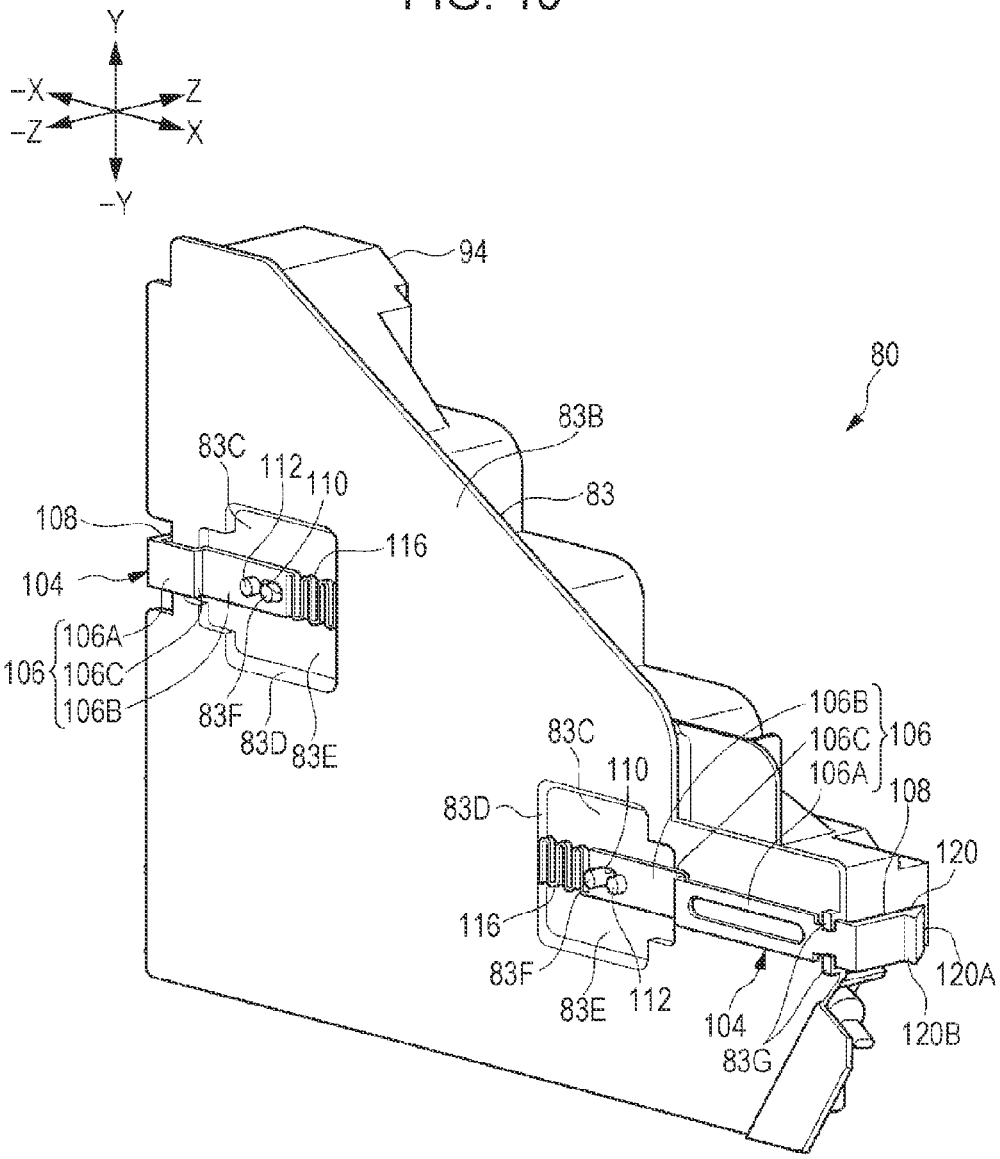
FIG. 10 is a structural perspective view of the storage container from which covers and a grip part are removed.

FIG. 10 illustrates the toner container 80 from which below-described covers 140 and the grip part 130 are removed. As illustrated in FIG. 10, each of the latch members 104 includes a first arm portion 106 extending in the X-direction along a detachment direction (−Z-direction) side face 83B of the opposing wall 83, and a second arm portion 108 extending in the attachment direction (Z-direction) of the toner container 80 along the surrounding wall 94. The latch member 104 is L-shaped in plan view (as viewed in the −Y-direction).

A recess 83C is provided in a position on the opposing wall 83 where each first arm portion 106 is located. In the recess 83C, a depth face 83E indented from the side face 83B in the Z-direction, and a side wall 83D provided along the outer periphery of the depth face 83E (along an inner edge of the recess 83C) are provided. The depth face 83E has a projecting portion 83F projecting in the −Z-direction.

Each first arm portion 106 includes a first portion 106A provided along the side face 83B of the opposing wall 83, a second portion 106B provided along the depth face 83E in the recess 83C and located closer to the Z-direction side than the first portion 106A, and a connecting portion 106C that connects the first portion 106A and the second portion 106B.

The second portion 106B has a slot 110 extending in the X-direction. The projecting portion 83F is inserted through the slot 110 so that the latch member 104 is supported movably in the X-direction and the −X-direction. More specifically, in a state in which the container body 84 is attached to the image forming apparatus body 11, each latch member 104 moves in the X-direction and the −X-direction between a latch position where the latch portion 120 is latched in the latched portion 11A of the image forming apparatus body 11 (see FIG. 13) and a withdrawal position where the latch portion 120 is withdrawn from the latch position (see FIG. 15).

An inner rim of the slot 110 of the second portion 106B on an X-direction center side of the toner container 80 (hereinafter simply referred to as an "X-direction center side") contacts with the projecting portion 83F so as to prevent the latch portion 120 from moving beyond the latch position to an X-direction outer side of the toner container (hereinafter simply referred to as an "X-direction outer side") opposite the withdrawal position.

The X-direction center side of the toner container 80 refers to a −X-direction side of the X-direction side latch member 104 of the pair of latch members 104, and an X-direction side of the −X-direction side latch member 104 of the latch members 104. This also applies to a below-described pair of connecting portions 134 in the grip part 130. The X-direction outer side of the toner container 80 refers to an X-direction side of the X-direction side latch member 104, and a −X-direction side of the −X-direction side latch member 104. This also applies to the below-described connecting portions 134 in the grip part 130.

An inner rim on the X-direction outer side of the slot 110 of the second portion 106B contacts with the projecting portion 83F so as to prevent the latch portion 120 from moving beyond the withdrawal position toward the X-direction center side opposite the latch position.

On the X-direction center side of the slot 110 in the second portion 106B, a spring 116 is provided as an example of a biasing member that biases the latch portion 120 (latch member 104) to the latch position. The spring 116 is folded up and down in a wavy form. One end of the spring 116 in an extension and contraction direction (X-direction) contacts with and presses the side wall 83D on the X-direction center side of the recess 83C, so that the latch portion 120 is biased to the latch position. In the exemplary embodiment, the spring 116 is provided integrally with the latch portion 120 (latch member 104).

Figure 11:
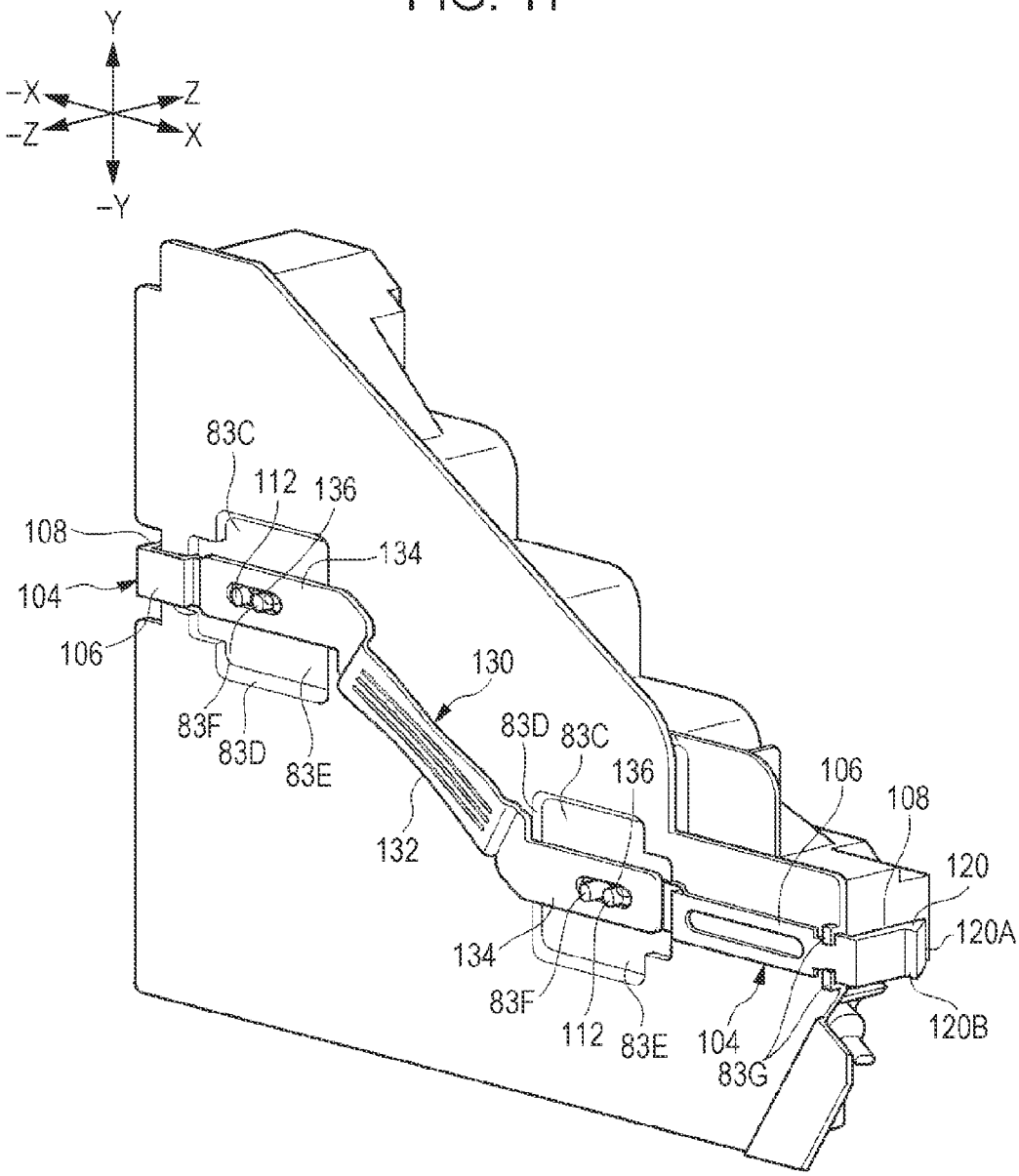
FIG. 11 is a structural perspective view of the storage container from which the covers are removed.

On the X-direction outer side of the slot 110 in the second portion 106B, a projecting portion 112 projects in the −Z-direction. As illustrated in FIG. 11, the projecting portion 112 is inserted through a slot 136 provided in a below-described connecting portion 134 of the grip part 130.

Each latch portion 120 is provided at a Z-direction end of the second arm portion 108. As illustrated in FIG. 13, a gap A is provided between the second portion 106B and the surrounding wall 94 of the container body 84, and the second portion 106B is elastically deformable so that the latch portion 120 moves toward the X-direction center side.

More specifically, the latch portion 120 is formed by a claw pointing toward the X-direction outer side, and includes a first face 120A and a second face 120B. The first face 120A faces in the attachment direction (Z-direction), and slopes toward the X-direction center side as it extends in the attachment direction. The second face 120B faces in the detachment direction (−Z-direction), and is orthogonal to the detachment direction. The second face 120B may be at an angle to the detachment direction (see FIGS. 16B and 16C). In contrast, specifically, each latched portion 11A provided in the image forming apparatus body 11 is formed by a recess by which the claw that forms the latch portion 120 can be caught, as illustrated in FIG. 2.

Figure 13A:
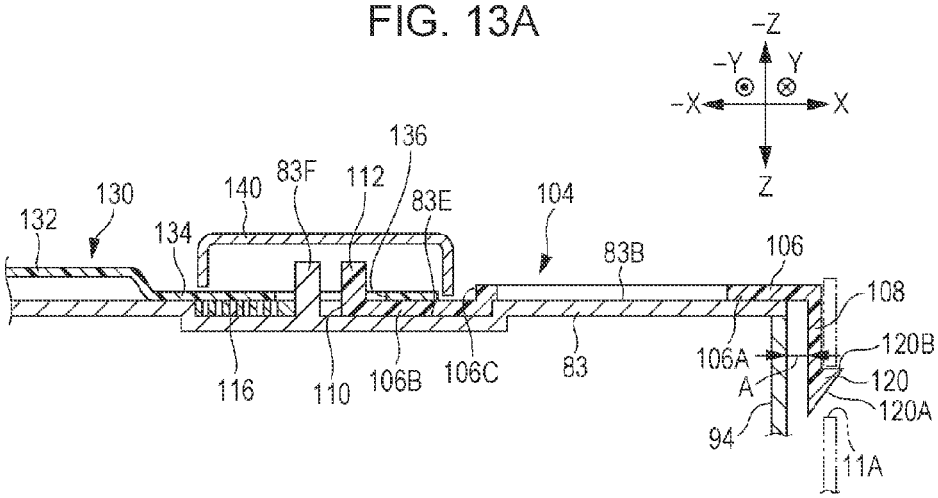
FIGS. 13A and 13B are an enlarged cross-sectional view and an enlarged front view, respectively, of a part of the grip part and a latch member in the exemplary embodiment.
Figure 13B:
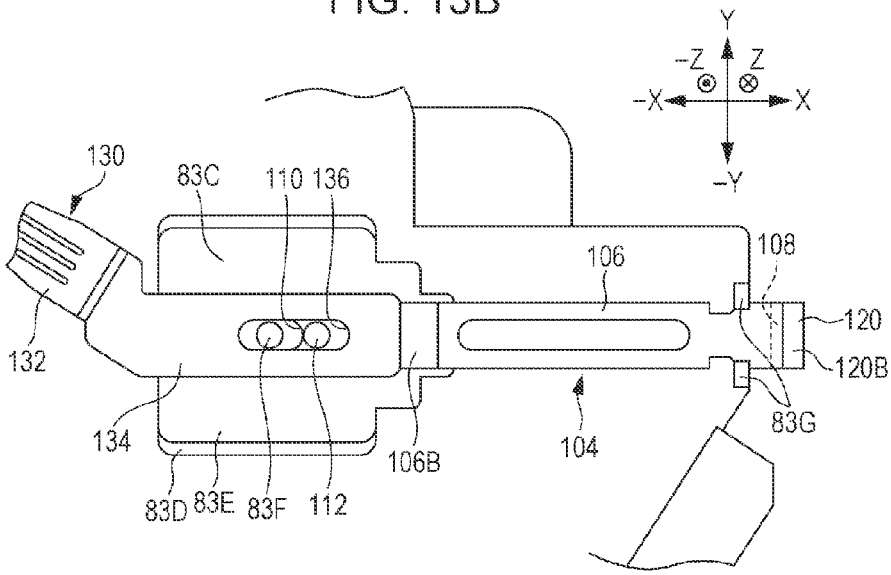
Figure 15A:
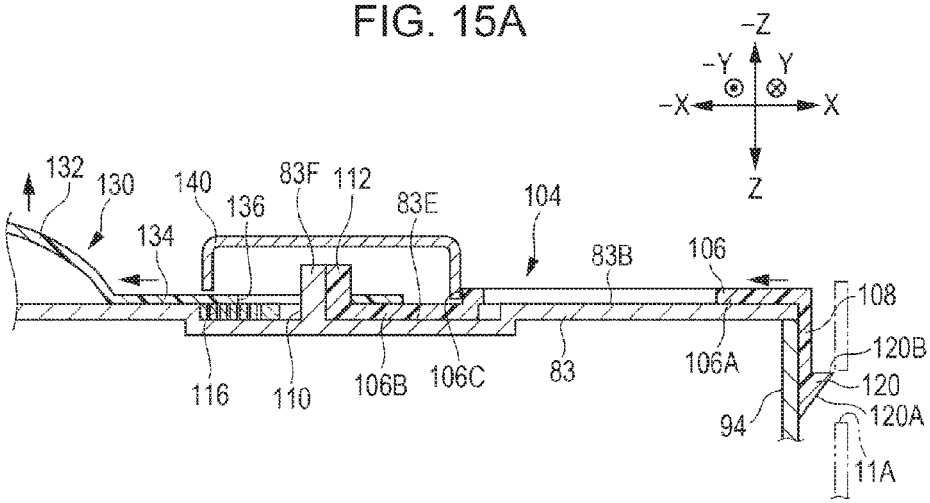
FIGS. 15A and 15B are operational diagrams illustrating an operation of further pulling out the grip part in the structure of FIGS. 14A and 14B.
Figure 15B:
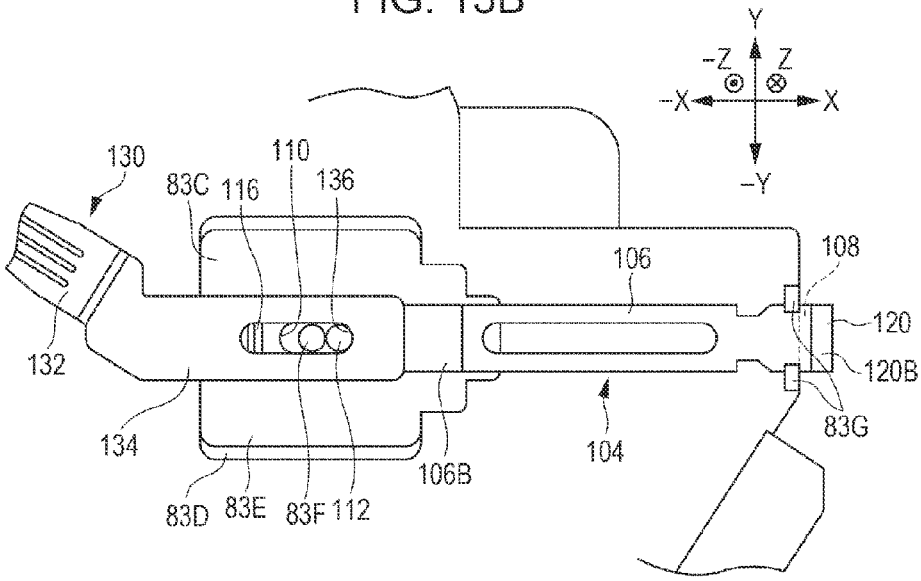

As illustrated in FIGS. 13A and 13B, the claw of the latch portion 120 is latched in the corresponding latched portion 11A of the image forming apparatus body 11 in a state in which the container body 84 is attached to the image forming apparatus body 11. This restricts detachment of the container body 84 from the image forming apparatus body 11. As illustrated in FIGS. 15A and 15B, when the latch portion 120 withdraws from the latch position in the latched portion 11A, the container body 84 is allowed to be detached from the image forming apparatus body 11.

Figure 12:
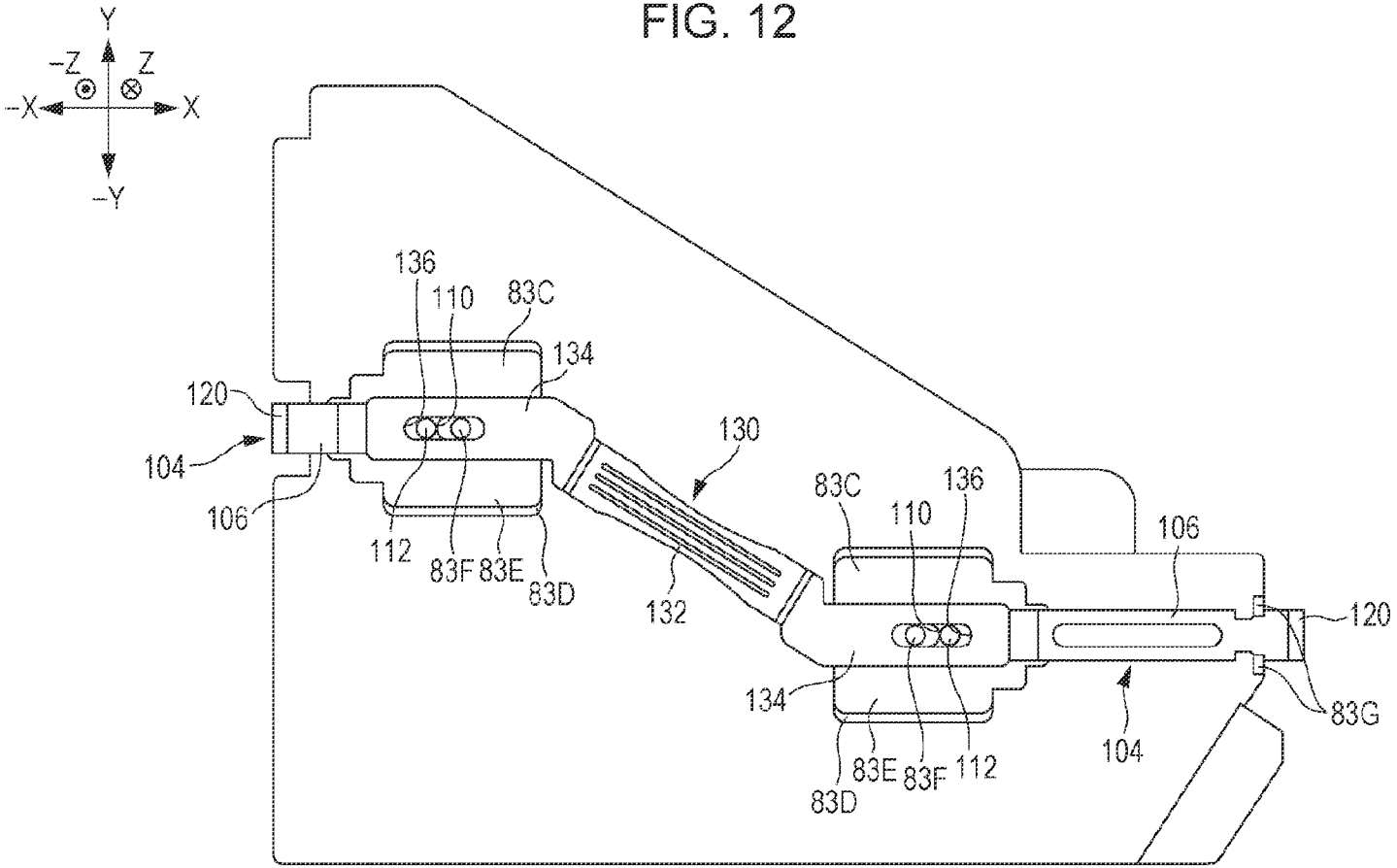
FIG. 12 is a structural front view of the storage container from which the covers are removed.

As illustrated in FIG. 12, the −X-direction side latch member 104 is located at the center in the up-down direction of the container body 84. The X-direction side latch member 104 is located on a lower side (−Y-direction side) of the −X-direction side latch member 104. Thus, in the exemplary embodiment, a pair of latch portions 120 are located at different positions in the up-down direction at the side portions of the container body 84. More specifically, the latch portions 120 are arranged in a direction having the same inclination angle as that of an arrangement direction B of the insertion holes 93A (see FIG. 7). The X-direction side latch portion 120 is latched in the corresponding latched portion 11A on a lower side (−Y-direction side) of the −X-direction side latch portion 120. A line connecting the centers of the latch portions 120 in the up-down direction may be parallel to a line connecting the centers of two insertion holes 93A provided at both ends in the X-direction.

Similarly to the latch members 104, the grip part 130 is formed of an elastic material, for example, a resin material such as polypropylene (PP) or polyoxymethylene (POM), and is elastically deformable. The grip part 130 is to be gripped by the operator at least during detachment of the container body 84 (toner container 80) from the image forming apparatus body 11. The grip part 130 extends along the side face 83B of the opposing wall 83.

FIGS. 11 and 12 illustrate the toner container 80 from which below-described covers 140 are removed. As illustrated in FIGS. 11 and 12, the grip part 130 includes a belt-shaped grip portion 132 that forms a middle portion in the longitudinal direction, and connecting portions 134 that form both end portions in the longitudinal direction and that are connected to the latch members 104.

The connecting portions 134 are shaped like belts extending in the X-direction. An X-direction side connecting portion 134 is located on a lower side (−Y-direction side) of a −X-direction side connecting portion 134. The grip portion 132 extends obliquely with respect to the up-down direction and the X-direction such as to connect the pair of connecting portions 134. That is, the grip portion 132 extends obliquely with respect to the up-down direction and the X-direction from one of the latch portions 120 (latch members 104) toward the other. The entire grip part 130 may extend obliquely with respect to the up-down direction and the X-direction toward the pair of latch portions 120 (latch members 104).

Figure 14A:
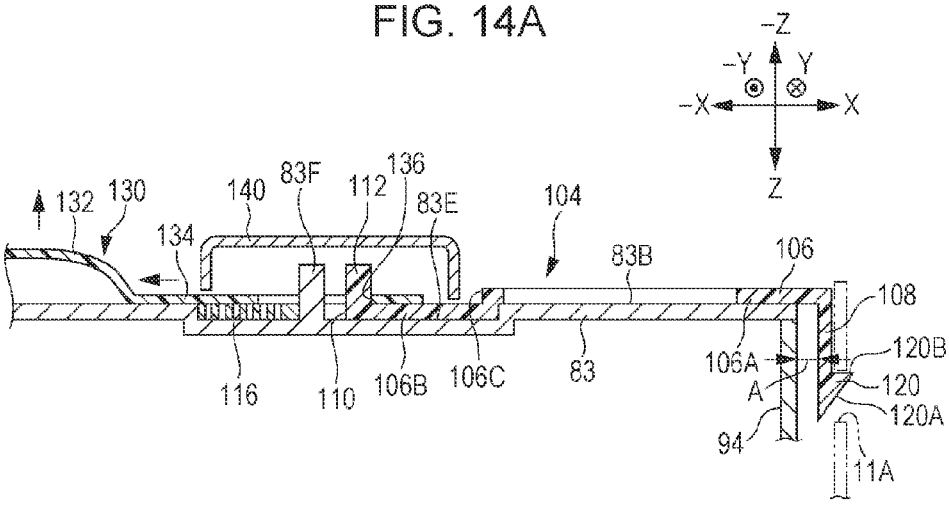
FIGS. 14A and 14B are operational diagrams illustrating an operation of pulling out the grip part in the structure of FIG. 13.
Figure 14B:
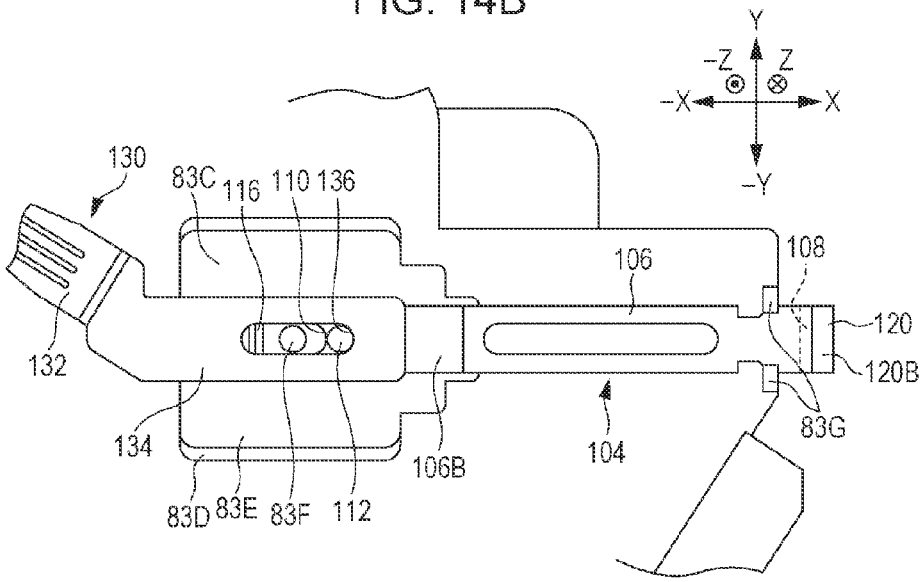

When the grip portion 132 is pulled out from the image forming apparatus body 11, it separates from the container body 84 while curving to be convex in the −Z-direction, so that a space in which the operator inserts the hand (a space between the grip portion 132 and the image forming apparatus body 11) is widened (see FIGS. 14 and 15).

Each of the connecting portions 134 has a slot 136 extending in the X-direction. The projecting portion 83F and the projecting portion 112 are inserted through the slot 136 of the connecting portion 134 so that the connecting portion 134 is supported movably in the X-direction. The connecting portion 134 is placed on the second portion 106B of the corresponding latch member 104.

When the grip portion 132 is pulled out, tension is produced by separation of the grip portion 132 from the image forming apparatus body 11. This tension moves each connecting portion 134 toward the X-direction center side.

When the connecting portion 134 is moved to the X-direction center side by pulling out the grip portion 132 of the grip part 130, an X-direction outer side of the slot 136 first comes into contact with the projecting portion 112 and moves the latch member 104 to a withdrawal position against the biasing force of the spring 116.

As illustrated in FIG. 9, covers 140 are provided at the recesses 83C in the opposing wall 83. Each of the covers 140 covers the connecting portion 134 placed on the second portion 106B of the corresponding latch member 104. The cover 140 presses the connecting portion 134 in a manner such that the second portion 106B and the connecting portion 134 are movable in the −X-direction (X-direction). This prevents separation of the second portion 106B from the projecting portion 83F and separation of the connecting portion 134 from the projecting portion 83F and the projecting portion 112.

A second arm portion 108 side (X-direction side) of the first portion 106A of the X-direction side latch member 104 is supported movably in the X-direction by support portions 83G provided on the side face 83B of the opposing wall 83 while being restricted in movement in the −Z-direction.

Operation of Exemplary Embodiment

Next, the operation of the exemplary embodiment will be described.

First, a description will be given of an attachment operation of attaching the toner container 80 to the image forming apparatus body 11.

To attach the toner container 80 to the image forming apparatus body 11, the operator first detaches the cover 13 (see FIG. 6) from the image forming apparatus body 11 (see FIG. 5), and pushes the toner container 80 into the image forming apparatus body 11 in the attachment direction (−Z-direction) in this state. At this time, the first faces 120A of the latch portions 120 in the latch members 104 move in the attachment direction (−Z-direction) while being in contact with the edges of the latched portions 11A, so that the second arm portions 108 of the latch members 104 elastically deform and the latch portions 120 are latched in the latched portions 11A (see FIG. 13).

When the toner container 80 is attached to the image forming apparatus body 11, as illustrated in FIG. 4, the discharge pipes 68 are inserted in the inserted spaces 86B in the cylindrical walls 86 through the insertion holes 93A of the insertion wall 93. Then, the pressing faces 72 of the discharge pipes 68 press the pressed faces 88C of the shutters 88 against the biasing forces of the compression coil springs 81, and move the shutters 88 to an opening position. Further, the distal ends 87A of the projecting portions 87 press the distal faces 76 of the opening and closing pipes 74 against the biasing forces of the compression coil springs 71, and move the opening and closing pipes 74 to an opening position.

As a result, the open ports 75A of the opening and closing pipes 74 open the discharge ports 69 of the discharge pipes 68, and the shutters 88 open the input ports 86A of the cylindrical walls 86. This allows residual toner to flow from the discharge pipes 68 into the receiving portion 85 of the toner container 80.

In the exemplary embodiment, while the toner container 80 is attached to the image forming apparatus body 11, it is pressed in the detachment direction (−Z-direction) by reaction forces from the compression coil springs 81 and the compression coil springs 71 in a compressed state. Since the compression coil springs 81 and the compression coil springs 71 are located in the insertion holes 93A, the toner container 80 receives the reaction forces along the arrangement positions of the insertion holes 93A. In the exemplary embodiment, since the latch portions 120 are arranged in the direction having the same inclination angle as that of the arrangement direction B of the insertion holes 93A (see FIG. 7), they are latched in the latched portions 11A against the reaction forces.

Next, an operation of detaching the toner container 80 from the image forming apparatus body 11 will be described.

To detach the toner container 80 from the image forming apparatus body 11, the operator first puts the tip of the operator's finger between the grip portion 132 of the grip part 130 and the container body 84, and grips and pulls out the grip portion 132 in the −Z-direction, as illustrated in FIG. 14. Thus, the space in which the hand of the operator is inserted (the space between the grip portion 132 and the image forming apparatus body 11) is widened. FIG. 13 illustrates a state of the grip portion 132 before the pull-out operation, and FIG. 14 illustrates a state of the grip portion 132 after the pull-out operation.

When the grip portion 132 is pulled out in the −Z-direction, the connecting portions 134 of the grip part 130 move to the X-direction center side, and the inner rims on the x-direction outer sides of the slots 136 come into contact with the projecting portions 112. Until the inner rims of the slots 136 contact with the projecting portions 112, the latch members 104 do not move, but only the connecting portions 134 move.

When the operator further pulls out the grip portion 132 in the −Z-direction, as illustrated in FIG. 15, the space in which the hand of the operator is inserted (the space between the grip portion 132 and the image forming apparatus body 11) is widened further. Also, the projecting portions 112 are pressed by the inner rims of the slots 136 on the X-direction outer sides, and the latch members 104 move to the X-direction center side against the biasing forces of the springs 116. Thus, the latch portions 120 of the latch members 104 move to a withdrawal position. This allows the container body 84 to be detached from the image forming apparatus body 11.

When the operator further pulls out the grip portion 132 in the −Z-direction, the toner container 80 is detached from the image forming apparatus body 11.

When the operator releases the grip part 130, the latch members 104 are moved to the X-direction outer sides by the biasing forces of the springs 116, and the grip portion 132 of the grip part 130 moves in the Z-direction toward the container body 84 (see FIG. 13).

In the exemplary embodiment, the latch portions 120 withdraw from the latch positions in the latched portions 11A in conjunction with the operation of pulling out the grip portion 132 of the grip part 130 in the −Z-direction. Hence, an operation of withdrawing the latch portions 120 separately from the pull-out operation of the grip part 130 is unnecessary. This may enhance operability in detachment of the toner container 80 from the image forming apparatus body 11.

In the exemplary embodiment, the latch portions 120 withdraw from the latch positions in the latched portions 11A. Hence, compared with a case in which the latch portions 120 do not withdraw from the latch positions in the latched portions 11A, the force for pulling out the toner container 80 from the image forming apparatus body 11 may be reduced, and operability in detachment of the toner container 80 from the image forming apparatus body 11 may be enhanced.

Figure 16A:
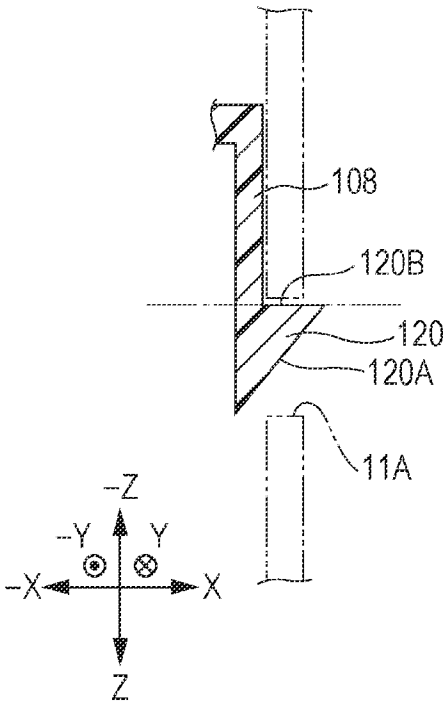
FIGS. 16A, 16B, and 16C schematically illustrate a structure of the latch portion of the exemplary embodiment and structures of latch portions of comparative examples.
Figure 16B:
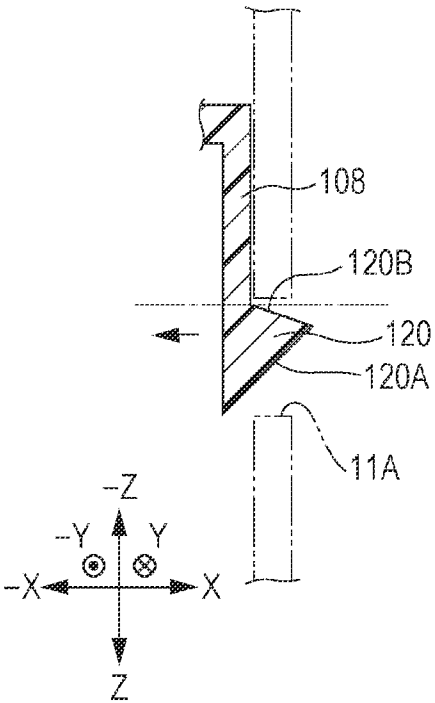

In the exemplary embodiment, since the latch portions 120 withdraw from the latch positions in the latched portions 11A, there is no need to set the angle of the second faces 120B of the latch portions 120 at an angle that allows the second faces 120B to be easily pulled out from the latched portions 11A. That is, it is unnecessary that the second faces 120B of the latch portions 120 slope toward the X-direction center side as they extend in the detachment direction (−Z-direction) so as to be moved toward the X-direction center side by contact with the latched portions 11A, as illustrated in FIG. 16B. Even when the second faces 120B are orthogonal to the detachment direction (−Z-direction) (see FIG. 16A) and the latch portions 120 are firmly latched in the latched portions 11A, as in the exemplary embodiment, the toner container 80 can be detached from the image forming apparatus body 11.

Figure 16C:
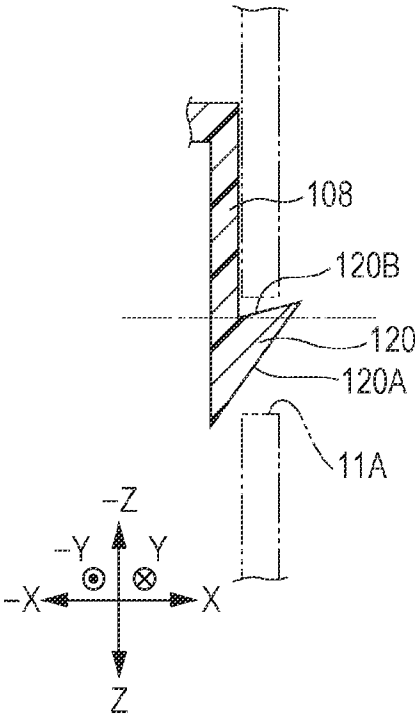

As illustrated in FIG. 16C, the second faces 120B of the latch portions 120 may slope toward the X-direction outer side as they extend in the detachment direction (−Z-direction). One-dot chain lines in FIGS. 16A to 16C represent a line orthogonal to the detachment direction (−Z-direction).

Since the latch portions 120 are thus firmly latched in the latched portions 11A in the exemplary embodiment, it is necessary to restrict movement of the toner container 80 in the −Z-direction while pressing the toner container 80 with the cover 13. Hence, the cover 13 does not need to have a large thickness. This may reduce the thickness of the image forming apparatus 10 in the detachment direction (−Z-direction).

In the exemplary embodiment, when the operator releases the grip part 130, the grip portion 132 of the grip part 130 is moved in the Z-direction by the biasing forces of the springs 116 to approach the container body 84. Hence, the space occupied by the grip part 130 in the detachment direction (−Z-direction) is reduced, and the thickness of the toner container 80 in the detachment direction (−Z-direction) is reduced. This may reduce the thickness of the image forming apparatus 10 in the detachment direction (−Z-direction).

While the toner container 80 is used as the detachable unit to be attached to and detached from the image forming apparatus body 11 in the exemplary embodiment, any component to be attached to and detached from the image forming apparatus body 11 may be used.

While the storage container that stores waste toner is used as the toner container 80 to be attached to and detached from the image forming apparatus body 11 in the exemplary embodiment, for example, a storage container that stores toner to be supplied to the developing devices 38 may be used. It is satisfactory as long as the storage container stores toner.

While a pair of latch portions 120 are provided in the exemplary embodiment, only one latch portion 120 may be provided in the container body 84. In this case, for example, one of the pair of latch portions 120 may be replaced with a restricting portion that restricts movement of the container body 84 in the −Z-direction by contact with the −Z-direction side face of the container body 84.

While the springs 116 serving as an example of a biasing member that biases the latch members 104 to the latch positions are provided integrally with the latch portions 120 in the exemplary embodiment, they may be provided separately from the latch portions 120.

While the grip part 130 is belt-shaped and the grip portion 132 is oblique with respect to the X-direction in the exemplary embodiment, the shape and position of the grip part 130 may be changed variously.

While the pair of latch portions 120 are located at positions shifted from each other in the up-down direction in the exemplary embodiment, they may be located at the same position in the up-down direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable unit comprising:

a detachable unit body to be attached to an image forming apparatus body such as to be detachable in a predetermined detachment direction;

a grip part provided in the detachable unit body;

a latch portion provided in the detachable unit body, the latch portion being latched in a latched portion provided in the image forming apparatus body to restrict detachment of the detachable unit body from the image forming apparatus body in a state in which the detachable unit body is attached to the image forming apparatus body, and withdrawing from a latch position in the latched portion in conjunction with a pull-out operation of pulling out the grip part from the detachable unit body in the detachment direction; and a biasing member provided in the detachable unit body to bias the latch portion to the latch position, wherein the latch portion withdraws from the latch position in conjunction with the pull-out operation of pulling out the grip part in the detachment direction against a biasing force of the biasing member.

2. The detachable unit according to claim 1, wherein the biasing member is formed by a spring provided integrally with the latch portion.

3. The detachable unit according to claim 1, wherein the grip part is belt-shaped, and the latch portion is withdrawn from the latch position against the biasing force by a tension produced when a middle portion of the grip part in a longitudinal direction is separated from the detachable unit body by the pull-out operation.

4. The detachable unit according to claim 3, wherein a pair of the latch portions are provided at different positions in an up-down direction in a side portion of the detachable unit body, and wherein at least the middle portion of the grip part in the longitudinal direction extends obliquely with respect to the up-down direction from one of the pair of the latch portions toward the other of the pair of the latch portions.

5. An image forming apparatus comprising:

a toner container that forms the detachable unit according to claim 1;

an image forming apparatus body to and from which the toner container is attached and detached; and a latched portion provided in the image forming apparatus body such that the latch portion is latched in the latched portion.

6. A detachable powder container comprising:

a detachable powder container body to be attached to an image forming apparatus body such as to be detachable in a predetermined detachment direction;

a pull part provided in the detachable powder container body;

a latch portion provided in the detachable powder container body, the latch portion, in a state in which the detachable powder container body is attached to the image forming apparatus body, protruding from the outer surface of the detachable powder container body with a protruding length and being latched in a latched portion provided in the image forming apparatus body to restrict detachment of the detachable powder container body from the image forming apparatus body, and withdrawing from a latch position in the latched portion by reducing the protruding length in conjunction with a pull-out operation of pulling out the pull part from the detachable powder container body in the detachment direction; and a biasing member provided in the detachable powder container body to bias the latch portion to the latch position, wherein the latch portion withdraws from the latch position in conjunction with the pull-out operation of pulling out the pull part in the detachment direction against a biasing force of the biasing member.

7. The detachable unit according to claim 6, wherein the latch portion protrudes substantially perpendicularly from the outer surface of the detachable powder container body.

8. A detachable powder container comprising:

a detachable powder container body to be attached to an image forming apparatus body such as to be detachable in a predetermined detachment direction, the detachable powder container body having a powder transporting opening;

a pull part provided in the detachable powder container body;

a latch portion provided in the detachable powder container body, the latch portion being latched in a latched portion provided in the image forming apparatus body to restrict detachment of the detachable powder container body from the image forming apparatus body in a state in which the detachable powder container body is attached to the image forming apparatus body, and withdrawing from a latch position in the latched portion in conjunction with a pull-out operation of pulling out the pull part from the detachable powder container body in the detachment direction; and a biasing member provided in the detachable powder container body to bias the latch portion to the latch position, wherein the latch portion withdraws from the latch position while being moved close to the powder transporting opening in conjunction with the pull-out operation of pulling out the pull part in the detachment direction against a biasing force of the biasing member.

9. A detachable powder container comprising:

a detachable powder container body to be attached to an image forming apparatus body such as to be detachable in a predetermined detachment direction, the detachable powder container body having a powder transporting opening and a opening shutter opening and closing the powder transporting opening;

a first biasing member provided in the detachable powder container body to bias the opening shutter to a closing position of the powder transporting opening and compressed, in a attached state in which the detachable powder container body is attached to the image forming apparatus body, to bias the detachable powder container body in the detachment direction;

a pull part provided in the detachable powder container body;

a latch portion provided in the detachable powder container body, the latch portion being latched in a latched portion provided in the image forming apparatus body to restrict detachment of the detachable powder container body from the image forming apparatus body in the attached state and withdrawing from a latch position in the latched portion in conjunction with a pull-out operation of pulling out the pull part from the detachable powder container body in the detachment direction, wherein in the attached state the first biasing member is compressed to bias the latch portion to the latch position in the detachment direction by biasing the detachable powder container body in the detachment direction; and a second biasing member provided in the detachable powder container body to bias the latch portion to the latch position, wherein the latch portion withdraws from the latch position in conjunction with the pull-out operation of pulling out the pull part in the detachment direction against a biasing force of the second biasing member.

* * * * *